United States Patent [19]

Moraly

[11] Patent Number: 4,589,500

[45] Date of Patent: May 20, 1986

[54] TOOL FOR DRIVING IN AND GUIDING PEGS FOR FIXING STAKES

[76] Inventor: Paul Moraly, 168, 170 rue Victor-Hugo, 93110 Rosny Sous Bois, France

[21] Appl. No.: 588,872

[22] PCT Filed: May 31, 1983

[86] PCT No.: PCT/FR83/00103

§ 371 Date: Feb. 3, 1984

§ 102(e) Date: Feb. 3, 1984

[87] PCT Pub. No.: WO83/04424

PCT Pub. Date: Dec. 22, 1983

[30] Foreign Application Priority Data

Jun. 8, 1982 [FR] France ..... 82 09943

[51] Int. Cl.[4] ..... B25D 9/00

[52] U.S. Cl. ..... 173/90; 173/132; 405/232

[58] Field of Search ..... 173/90, 128, 132; 405/232

[56] References Cited

U.S. PATENT DOCUMENTS 52,799 2/1866 Winter ..... 173/90 X 299,086 5/1884 Over ..... 173/90 X 2,633,947 4/1953 Schiff ..... 189/92

3,696,873 10/1972 Anderson ..... 173/132

3,823,785 7/1974 Toliver ..... 173/90 X

FOREIGN PATENT DOCUMENTS 104528 3/1917 United Kingdom .

*Primary Examiner*—James M. Meister

*Assistant Examiner*—Willmon Fridie, Jr.

*Attorney, Agent, or Firm*—William A. Drucker

[57] ABSTRACT

A tool for driving into the ground pegs having a central sleeve and projecting fins, said pegs being adapted for anchoring stakes into the ground, said tool comprising a rod-like body with pointed lower end and a projecting central part forming a lower transverse surface which is adapted for bearing on the projecting fins of the peg and a ram member sliding along the upper part of the rod-like body to impart blows on said projecting central part. The tool of this invention has a bell-shaped member capping the projecting central part and a flat member assembled to the base of the projecting central portion. It has particularly high resistance to the blows and allows easy replacement of its most fragile parts in case of wear or breakage.

5 Claims, 5 Drawing Figures

TOOL FOR DRIVING IN AND GUIDING PEGS FOR FIXING STAKES

BACKGROUND OF THE INVENTION

1. Field of the Invention

The invention relates to the anchorage, in the ground, of posts or stakes by means of a peg having a rigid part, advantageously formed of metal plates shaped as fins, said rigid part forming a sleeve for receiving the base of the post or stake once the peg has been driven into the ground.

2. Description of the Prior Art

For driving such pegs into the ground there has priorly been proposed using a tool comprising a rigid elongate body and a sleeve forming a ram, mounted for sliding on the upper part of said elongate body so as to cooperate with a flat upper transverse surface of a central washer with which said elongate body is fitted, whereas a lower transverse surface of said washer, situated at a distance from the lower end of said elongate body slightly greater than the height of the peg, bears by its peripheral portion on the rigid part and is provided with a central recess. With such a tool, the operation for driving in a peg is achieved by introducing, into the sleeve thereof when it is simply laid on the ground in a vertical position, the lower part of the body of the tool, which thus plays the role of a false stake, over a length slightly greater than the height of the peg, so that the lower end of the body of the tool penetrates slightly into the ground. Then the ram, provided for this purpose with operating handles, is caused to slide over the upper part of the body of the tool so as to impart repeated blows on said upper transverse surface or striking surface. The lower transverse surface or bearing surface transmits the impacts to the upper edge of the fins of the peg and drive this latter into the ground along the general axis of the tool with guiding by the upper part of the body of the tool. When the peg has been driven completely into the ground, the false stake is withdrawn and a stake is introduced into the sleeve of the peg until its base penetrates slightly into the ground, to the depth reached by the lower end of the false stake. during the operation for driving in the peg, the central recess of the bearing surface of the tool protects the sleeve of the peg from damage through upsetting which would prevent the subsequent positioning of the stake.

Finally, this tool allows the peg to be well driven into the ground without deforming it and without letting the earth penetrate into its sleeve.

It presents however a difficulty in construction due to the fact that the application of violent shocks causes considerable risk of breakage, in particular at the level of the central protuberance of the body or of the junctions of the handles with the ram.

The invention provides a tool of the above-defined type which offers a particularly high impact resistance and further allows easy replacement of the most fragile elements in the case of wear or breakage.

SUMMARY OF THE INVENTION

According to the main feature of the invention, the central part of the elongate body comprises: an upper portion with larger section capped by a bell-shaped part whose upper surface is provided with a central passage for the upper part of the elongate body and forms said striking surface; and a lower portion whose section has a dimension equal to the circle inscribed in the horizontal section of the sleeve of the peg, said lower portion being surrounded by a flat part whose lower surface forms said bearing surface and whose upper surface is connected to the base of said bell.

According to another feature of the invention, the lower part or pin of said elongate body comprises a lower end portion whose section has a dimension substantially equal to that of the sleeve of the peg and having a pointed end and an upper portion connected to said lower portion of said central part and of reduced section.

According to a preferred embodiment, the whole of said elongate body, including its upper part or handle, its central part with its two different sections corresponding to two separate cylindrical portions or to a single truncated cone shaped portion and its lower part with a portion of reduced section and a pointed endmost portion or "plug", is formed in a single piece, advantageously by casting or forging whereas the striking bell and the flat bearing piece are added parts.

According to an additional important feature of the invention, the handles of the ram have a lower end made integral with the body of the sleeve, preferably by a long longitudinal weld, whereas their curved upper end penetrates freely into a longitudinal channel which opens at the upper end surface of the sleeve and has a depth greater than the length of the handle portion which penetrates therein.

BRIEF DESCRIPTION OF THE DRAWINGS

Other features as well as the advantages of the invention will clearly appear from the following description.

In the accompanying drawings:

FIG. 1 is a longitudinal sectional view of the elongate body of a tool according to a preferred embodiment of the invention, of which

DESCRIPTION OF THE PREFERRED EMBODIMENTS

Figure 1:
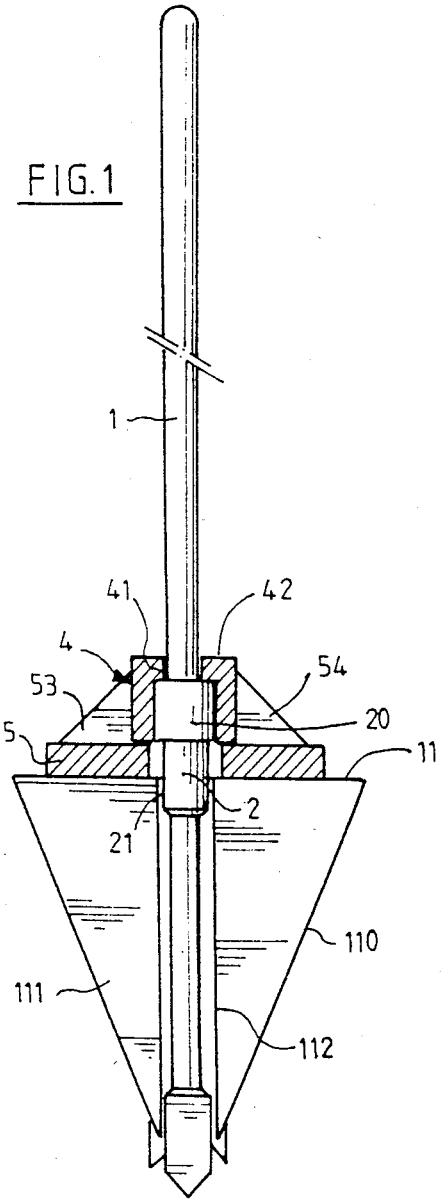

In FIG. 1 it can be seen that the elongate body of the tool, formed, in the preferred embodiment described, as a single cast piece, which process allows a body to be obtained inexpensively in which the longitudinal fibers of the metal (steel for example) are preserved and thus offer great tear strength comprises: a cylindrical handle 1, for example 30 mm in diameter and 900 mm in length, a central part 2, formed of an upper cylindrical portion 20 with a diameter for example of 50 mm and a lower cylindrical portion 21 for example 50 mm in height and 35 mm in diameter which corresponds substantially to the dimension of the inscribed circle of the section of the sleeve (112, FIG. 1) of the peg (11) the most generally used; and a pin 3 formed of a lower pointed plug 32 with a height of 190 mm and a section the same as that of the sleeve of the peg and an upper portion 31, 260 mm in height and with a reduced diameter equal to 28 mm in the example considered.

The upper portion 20 of the central part is capped by a bell 4 having, for example, an outer diameter of 80 mm and a height of 65 mm and fitting exactly over said upper portion 20, a central passage 41 for handle 1 to pass through its upper striking surface 42. The bell rests at its base on the upper surface of a flat part 5, 30 mm thick and having a central circular preservation recess 51 of a diameter for example of 60 mm, and through which the portion 21 passes coaxially.

The lower surface 52 of the flat part 5 serves as bearing surface and its largest dimension is for example equal to 250 mm. The said bearing surface is applied on the upper edge surface of the wings 110–111 of the peg 11, as illustrated in FIG. 1.

Figure 4:
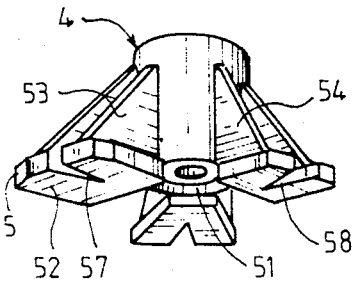
FIGS. 4 and 5 show, in perspective, two embodiments of the striking bell and of the bearing part.
Figure 5:
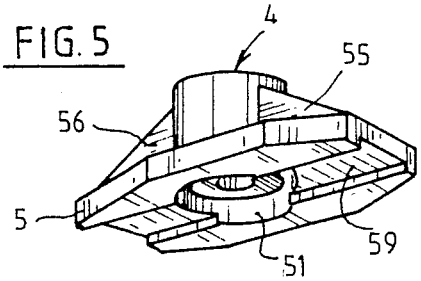

Advantageously, this bearing surface is not circular but comprises for example one of the shapes lightened by recesses 57;58 illustrated in FIGS. 4 and 5, where it can also be seen that the bearing piece 5 is provided with strengthening fins, such as 53 to 56, integral with the striking bell 4, whereas the bearing surface is provided with one or more longitudinal notches, such as 59, which facilitate positioning on the fins of the peg. Of course, the shape of the bearing surface will be adapted to the geometrical configuration of the fin assembly.

It will be noted that the central part in the shape of a protuberance 2 has a high mechanical strength and allows, on the one hand, a spigot element 20 to be formed for the striking bell 4, and on the other hand a portion 21 which cooperates with plug 32 for providing relative guiding of the peg and of the false stake.

With the striking bell, the section of the striking surface with which the base of the ram cooperates can be increased without for all that excessively increasing the section of the body of the tool, which must be as light as possible.

Plug 32 has over the whole of its height, except for the pointed portion, a section such that its shape matches perfectly that of the sleeve of the peg, within a few tenths of a mm and lubrication is recommended for facilitating withdrawal of the tool at the end of the driving operation. The very small thickness of the clearance prevents penetration of earth therein during driving in.

The intermediate reduced section 31 reduces the risk of adhesion of the false stake to the sleeve.

The bearing piece 5, bell 4 and even the central guide portion 21 and plug 32 may be removably mounted (by screwing, or by a spigot joint) so as to be able to be changed in the case of wear or breakage, or else, in so far as the plug and the central guide portion are concerned, for using the same tool for pegs having sleeves of different sections. As a variant, it is possible to give the central part 2 the shape of a truncated cone whose upper base will have a diameter of 50 mm for example and whose lower base will have a diameter of 35 mm. The section of this central portion will then have no discontinuity and its lower base will be connected also without discontinuity of section with an upper truncated cone shaped part of pin 3. The flat piece 5 will not have, in this variant, a central recess such as 51 in FIG. 1, but will be directly fitted on to the central part 2.

In this variant, simpler to construct than that of FIG. 1, the central truncated cone shaped part 2, by being engaged at the outset in the sleeve of the peg, will be jammed therein and, from the first impacts of the ram, the peg will be splayed out while rising along the central truncated cone shaped part 2, which will facilitate introduction of the post at the end of the operation. No risk of damaging the sleeve of the peg by upsetting exists.

Figure 2:
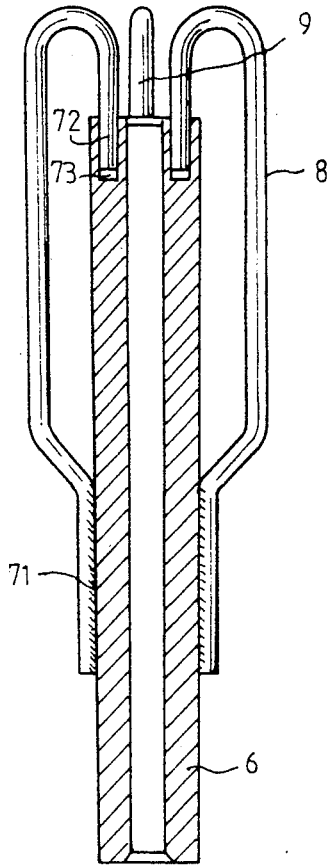
FIG. 2 shows the ram, also in longitudinal section.
Figure 3:
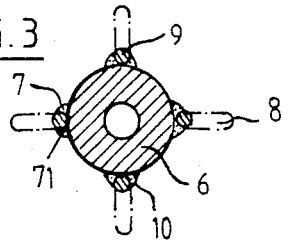
FIG. 3 shows said ram in cross section.

In FIGS. 2 and 3, it can be seen that the ram comprises a cylindrical sleeve 6 having for example a length of 600 mm, an outer diameter of 80 mm (equal to that of the striking surface 42) and an inner diameter of 31 mm, so slightly greater than that of the handle 1 on which it slides.

The relatively large height and the relatively small section of the ram provide better guiding of sliding with longer travel and an impact very closely centered on the striking surface.

In the example described, four handles 7,8,9,10 are provided disposed uniformly around the periphery of sleeve 6 and firmly fixed thereto at a single one of their ends. In fact, it has been discovered that securing the handle at both ends would cause a rigidity such that the shock waves would break the joints after a certain operating time. Preferably, the handle is secured at its lower part by a longitudinal weld 71, which offers very high resistance to tearing by the shock wave which takes place near-by. The top part of the handles is left free, which allows dissipation of the shock wave; so as to avoid however secondary parasite vibrations and deformations, this top part is curved at a level higher than that of the upper end of the sleeve and its end comes down and penetrates with a very small clearance in a channel 72 provided in the body of the annular sleeve and opening into the outer transverse surface thereof. A gap 73 is provided between the endmost surface of the handle and the bottom of the channel.

The handle 1 of the body of the tool could be truncated and the upper part thereof and the ram replaced by the piston of a hydraulic cylinder, or by any other mechanical driving device, the advantages provided by the construction of the central and lower parts of body 1 being retained.

Though the tool which has been disclosed is not usable exclusively with the peg described in prior U.S. patent, it has been more particularly designed for adapting thereto.

What is claimed is:

1. In combination:

i—a peg for fixing posts and stakes in the ground, said peg comprising a rigid member including at least two assembled metal plates which define an elongate central sleeve adapted to receive a base portion of said post or stake and form projecting fins, said projecting fins having an upper edge surface; and ii—a tool for driving said peg into the earth, said tool comprising a rigid elongate body having a lower part which has, at least on a portion of the length thereof, a cross-section which substantially matches the cross-section of said central sleeve for insertion of said lower part into said central sleeve, an upper part and a projecting central part and means, cooperating with said upper part, for imparting axially directed blows on said projecting central part, said projecting central part comprising: an upper portion of enlarged cross-section and a lower portion with a reduced cross-section substantially matching the cross-section of said central sleeve; a bell-shaped member capping the said upper portion and having a base and an upper surface portion which is provided with a central passage for the said upper part and forms a striking surface for said means; and a transverse flat member having a central aperture forming a passage for the said lower portion of the projecting central part, said flat member having an upper surface which is assembled with the base of the bell-shaped member and a lower transverse surface which is adapted for bearing on the upper edge surface of the projecting fins of the peg and is located at a distance from the end of said lower part at least equalling the length of the sleeve of the peg.

2. The combination, as claimed in claim 1, wherein said upper, central and lower parts of the elongate body are formed as a single member.

3. The combination, as claimed in claim 1, wherein said lower part of the elongate body has an endmost portion whose cross-section substantially matches that of the sleeve of the peg, said endmost portion having a pointed end, and an upper portion of reduced cross-section.

4. The combination, as claimed in claim 1, wherein the said means for imparting axially directed blows to the said striking surface comprise a sleeve forming a ram mounted for sliding along said upper part of the elongate body, at least first and second handles each having an elongate lower end portion which is firmly secured to the sleeve and an upper curved end portion which penetrates freely into a longitudinal channel which opens into the upper endmost surface portion of the sleeve, said channel having a depth greater than the length of the handle portion which penetrates therein.

5. The combination, as claimed in claim 1, wherein said transverse flat member is provided with strengthening fins formed integral with the said bell-shaped member and the lower transverse surface is provided with a plurality of lightening peripheral notches and with grooves adapted for positioning the bell-shaped member on the fins of the peg.

* * * * *